United States Patent [19]

Gould

[11] 4,165,621

[45] Aug. 28, 1979

[54] PENDANT RING

[75] Inventor: Joseph B. Gould, Las Vegas, Nev.

[73] Assignee: National Utilities Corporation, Monrovia, Calif.

[21] Appl. No.: 826,934

[22] Filed: Aug. 22, 1977

[51] Int. Cl.[2] ..... A44C 25/00; A44C 9/00

[52] U.S. Cl. ..... 63/1 R; 63/15; 24/13

[58] Field of Search ..... 63/1, 2, 15, 23; 24/3 K, 13

[56] References Cited

U.S. PATENT DOCUMENTS

| | | | |
|---|---|---|---|
| D. 50,056 | 12/1916 | Bonnevier | 63/15 UX |
| 252,998 | 1/1882 | Brunswick et al. | 63/1 R |
| 643,053 | 2/1900 | Halfmann | 63/1 R |
| 1,964,758 | 7/1934 | Guerin | 24/13 |
| 3,348,388 | 10/1967 | Elliott | 63/1 R |

FOREIGN PATENT DOCUMENTS

| | | | |
|---|---|---|---|
| 766125 | 4/1934 | France | 63/15 |

*Primary Examiner*—F. Barry Shay

*Attorney, Agent, or Firm*—William W. Haefliger

[57] ABSTRACT

A finger ring embodies a tube located so as to project sidewardly into the finger space and to have opposite ends contoured to match the curvature of the ring periphery. A holder such as a clasp is receivable into the tube.

7 Claims, 6 Drawing Figures

PENDANT RING

BACKGROUND OF THE INVENTION

This invention relates generally to jewelry, and more particularly concerns extending the display utility of finger rings.

Many persons desire to display valuable or decorative stones on their persons, as for example on finger rings. Multiple rings are often worn on the same finger, or different fingers, for this purpose. The wearer may, however, wish to display additional rings and or jewels mounted on such rings; however, there is no convenient way of accomplishing this end, and in a manner as to assure safe display, off the fingers.

SUMMARY OF THE INVENTION

It is a major object of the invention to provide a means for safety displaying, as for example on clothing, articles such as finger rings or jewels mounted on such rings, whereby the wearer has the option of either wearing the rings, or displaying them as pendants on his clothing, and in a safe and secure manner. Basically, the ornamental article comprises:

(a) a ring sized to be worn on a human finger or thumb, the ring defining an axis, (b) there being an opening extending through a continuous sector of the ring and adapted to receive a supporting holder.

As will be seen, a short tube may be fitted within the ring opening, the tube adapted to receive the supporting holder, and the tube having opposite ends contoured to have the curvature of the ring periphery at opposite ends of the opening. Typically, the holder may comprise a part such as a pin leg projecting through the opening and also through the pin bore, the pin or clasp being attachable to the wearer's clothing, and optionally in a concealed position, for safety, whereby the ring is suspended as a pendant but cannot be removed without access to the concealed pin or clasp.

Further, the tube may have a center and side portion openly exposed at the inner side of the ring, as will be seen, to provide for maximum tube length and support for the pin leg, while being concealed when the ring is worn on the finger.

These and other objects and advantages of the invention, as well as the details of an illustrative embodiment, will be more fully understood from the following description and drawings, in which:

DRAWING DESCRIPTION

DETAILED DESCRIPTION

Figure 5:
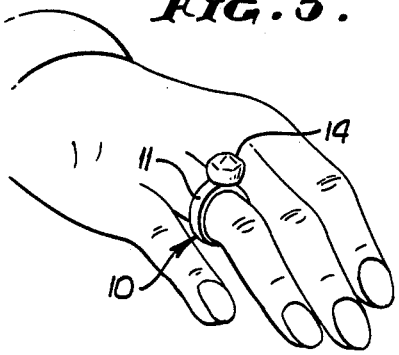
FIG. 5 shows the article of FIGS. 1–4 worn on a ring.

In the drawings, the ornamental article 10 comprises a ring 11 sized to be worn on a human finger or thumb, as for example as seen in FIG. 5. The ring defines a central, or near central, axis 12; also it includes an upper display head portion 13 adapted to mount a jewel, stone or other ornament such as is indicated at 14 in FIG. 5.

Figure 3:
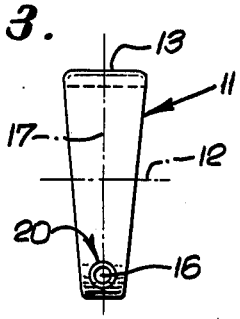
FIG. 3 is a side elevation taken on lines 3—3 of FIG. 2.

In accordance with the invention, an opening 15 extends through a continuous sector of the ring; and is adapted to receive a supporting holder. That sector is typically proximate but just above the lowermost portion 14 of the ring, and extends as indicated by angle $\alpha$ defining a transverse axis 16 such that a vertical plane 17 that contains axis 16 is normal to axis 12. Plane 17 bisects the head 13, as is clear from FIG. 3.

Figure 6:
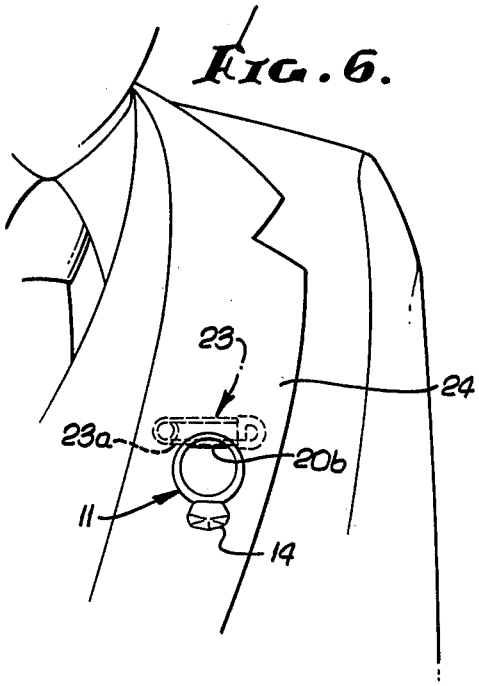
FIG. 6 shows the article of FIGS. 1–4 worn as a pendant.

A short tube 20 is preferably fitted in the opening 15, and has opposite ends **20*a* contoured to have the same curvature as the ring at opposite ends of the opening 15. The tube bore 21 is transversely elongated and sized to receive a holder part, such as pin leg 23*a* in FIG. 6. The pin or clasp is designated at 23, and removably attaches the ring to the wearer's clothing 24, whereby the ring 11 then hangs upside down, with the jewel 14 also on display. The pin 23 may optionally be located at the inside of the illustrated lapel 24, for concealment. Tube 20** may consist of a durable metal, as for example stainless steel, whereas the ring may consist of precious metal.

Figure 1:
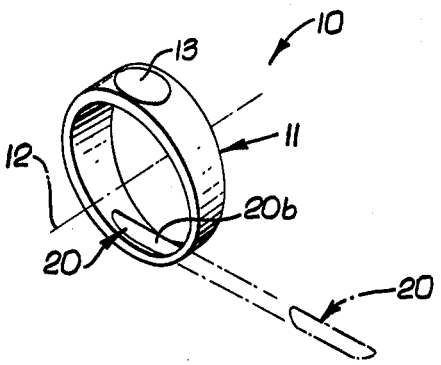
FIG. 1 is a perspective showing of a pendant ring incorporating the invention.
Figure 2:
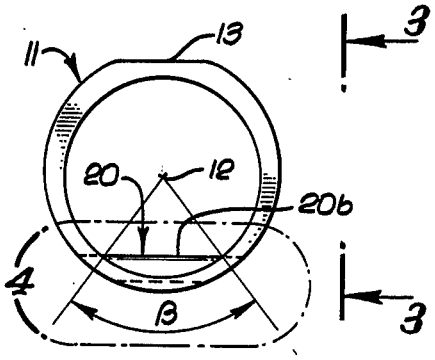
FIG. 2 is a front elevation showing of the FIG. 1 article.
Figure 4:
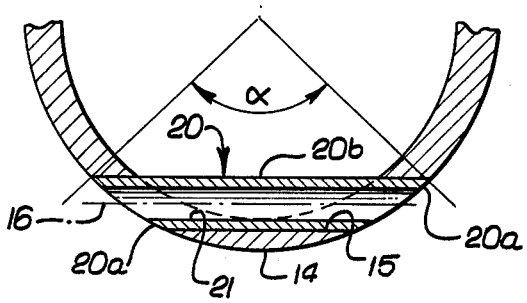
FIG. 4 is an enlarged view, partly in section of the indicated portion of FIG. 2.

It will be noted in FIGS. 1, 2 and 4 that the tube 20 has a central side portion **20*b* which is openly exposed at the inner side of the ring. That portion subtends and angle $\beta$, with respect to axis 12, the angle $\beta$ being smaller than the section angle $\alpha$ and contained therein. Angle $\beta$ is between about 30° to 90°. Portion 20*b* is concealed when the ring is worn on the finger as in FIG. 5; yet, it strengthens the ring for reception of the holder pin 23*a*, as is clear from FIG. 4. Also, it enables the tube 20 to have a continuous length sufficient to provide a durable bearing surface for pin leg 23*a*. The tube 20** may be suitably brazed or otherwise connected to the ring surfaces which it interfits.

I claim:

1. An ornamental article, comprising (a) a ring sized to be worn on a human finger or thumb, the ring defining an axis, (b) there being an elongated opening extending through a continuous sector of the ring and adapted to receive a supporting holder, (c) there being a short tube fitting within said opening, the tube adapted to receive such supporting holder, the tube having opposite ends contoured to have the curvature of the ring periphery at opposite ends of said opening, (d) the tube having a side portion projecting sidewardly into the open space surrounded by the ring, the tube having opposite end portions located completely within the ring itself.

2. The article of claim 1 including said holder having a part projecting through said opening.

3. The article of claim 2 wherein said holder comprises a clamp adapted to be attached to an article of clothing.

4. The article of claim 4 wherein said holder comprises a clasp adapted to attach to an article of clothing.

5. The article of claim 1 wherein said ring has a display head portion, said sector located at the opposite side of the ring from said head.

6. The article of claim 1 wherein a central side portion of the tube is openly exposed at the inner side of the ring, the extent of tube projection into said open space being less than the tube diameter.

7. The article of claim 6 wherein said central and exposed side portion of the tube subtends an angle with respect to said ring axis, and being between 30° and 90°.

* * * * *